United States Patent [19]

Danieli

[11] Patent Number: 4,680,875

[45] Date of Patent: Jul. 21, 1987

[54] DIVERSIFIABLE COMPLIANCE SOLE STRUCTURE

[75] Inventor: Diego Danieli, Caerano S. Marco, Italy

[73] Assignee: Calzaturificio F.lli Danieli S.p.A., Caerano S. Marco, Italy

[21] Appl. No.: 731,709

[22] Filed: May 8, 1985

[30] Foreign Application Priority Data

May 18, 1984 [IT] Italy ..... 30738/84[U]

[51] Int. Cl.[4] ..... A43B 13/14

[52] U.S. Cl. ..... 36/31; 36/28; 36/25 R; 36/59 A

[58] Field of Search ..... 36/92, 103, 114, 31, 36/28, 59 B, 59 A, 73

[56] References Cited

U.S. PATENT DOCUMENTS

| | | | |
|---|---|---|---|
| 157,985 | 12/1874 | Buxton | 36/59 A |
| 1,280,882 | 10/1918 | Simcoe | 36/59 B |
| 1,329,524 | 2/1920 | Hill | 36/59 B X |
| 1,518,910 | 12/1924 | Gammeter | 36/59 A X |
| 2,844,833 | 7/1958 | Odermatt | 36/59 A X |
| 2,885,797 | 5/1959 | Chrencik | 36/92 X |
| 4,318,232 | 3/1982 | Ching | 36/59 B X |
| 4,364,188 | 12/1982 | Turner et al. | 36/31 |

FOREIGN PATENT DOCUMENTS

| | | | |
|---|---|---|---|
| 1224031 | 2/1960 | France | 36/59 A |
| 401847 | 11/1933 | United Kingdom | 36/59 A |

*Primary Examiner*—Werner H. Schroeder
*Assistant Examiner*—T. Graveline
*Attorney, Agent, or Firm*—Guido Modiano; Albert Josif

[57] ABSTRACT

The diversifiable compliance sole structure comprises a sole portion, formed from a thermoplastic material and bonded to a sole element, formed by foaming. The structure has a bottom surface having a plurality of seats, adapted for removably accommodating reinforcing elements proximately to a peripheral region of a heel portion.

10 Claims, 2 Drawing Figures

DIVERSIFIABLE COMPLIANCE SOLE STRUCTURE

BACKGROUND OF THE INVENTION

The present invention relates to a diversifiable compliance sole structure particularly for sport footwear.

Known are sport shoes exhibiting diversified compliance which comprise multiple layers of elements, each having different stiffness characteristics, which are bonded together.

The main disadvantage is related to the stresses imparted by the foot, especially lateral ones, causing delamination of the layers. In an effort to solve this technical problem, sole structures have been provided which have diversifiable compliance features and are formed, at the heel region, with a series of identical and mutually parallel seats extending across said region.

Such seats are arranged to receive matingly shaped inserts spanning the entire length thereof, wherein each insert may have a different degree of stiffness.

Such prior sole designs are not devoid of shortcomings; in fact, the inserts, by spanning the whole length of the seats, confer on the sole a stiffness which is diversified and diversifiable longitudinally but not transversely, the stiffness imparted in the latter direction being uniform.

SUMMARY OF THE INVENTION

It is a primary aim of this invention to obviate such drawbacks affecting known sole types by providing a sole whose compliance is also diversifiable transversely to the longitudinal centerline of the sole.

A further important object is to provide a sole structure which affords improved control of the effects of any valgus condition of the foot.

Another object is to provide a sole structure which affords improved control of the effects of any varus condition of the foot.

An important object is to provide a sole structure which can be simultaneously used either to counteract the effects of valgus or varus conditions in the limb.

Another object is to provide a sole structure which can afford local diversification of its stiffness in accordance with different degrees of strengthening which may be variously combined together.

A not unimportant object is to provide a sole structure featuring diversifiable compliance, which is of relatively low cost and may be manufactured on standard manufacturing equipment.

These and other objects are achieved by a diversifiable compliance sole structure, characterized in that it comprises a sole formed from the thermoplastic material and bonded to a softer element formed by foaming, having at the bottom a plurality of seats for strengthening elements, said strengthening elements being removable from said seats.

BRIEF DESCRIPTION OF THE DRAWINGS

Further features and advantages will become apparent from the following detailed description of a structure according to the invention, as illustrated by way of example in the accompanying drawing, where.

DESCRIPTION OF THE PREFERRED EMBODIMENTS

Figure 1:
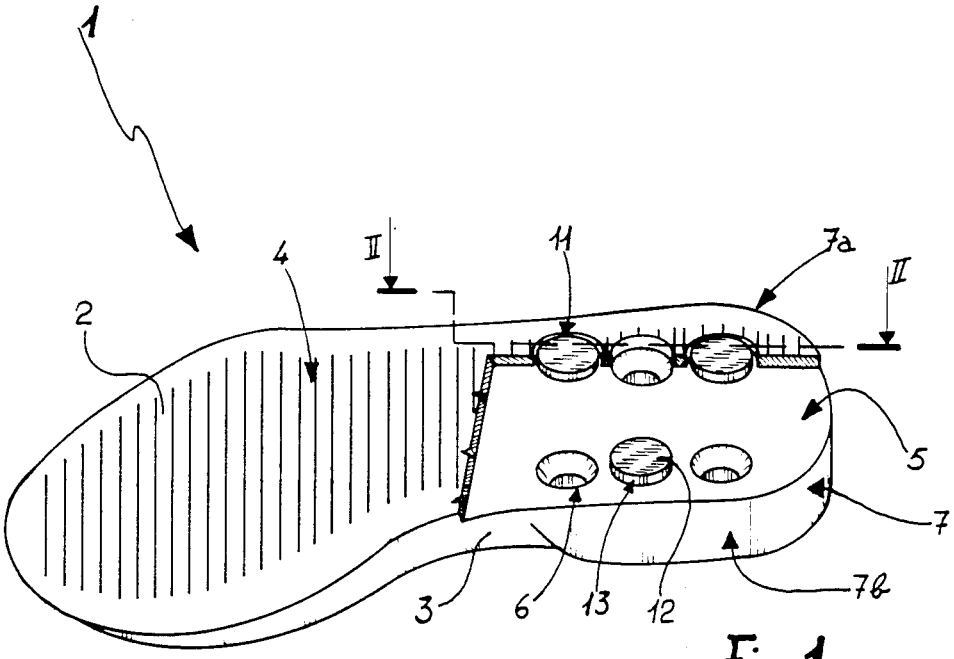
FIG. 1 is a perspective bottom view of the sole structure showing the seats and some of the strengthening elements inserted therein.
Figure 2:
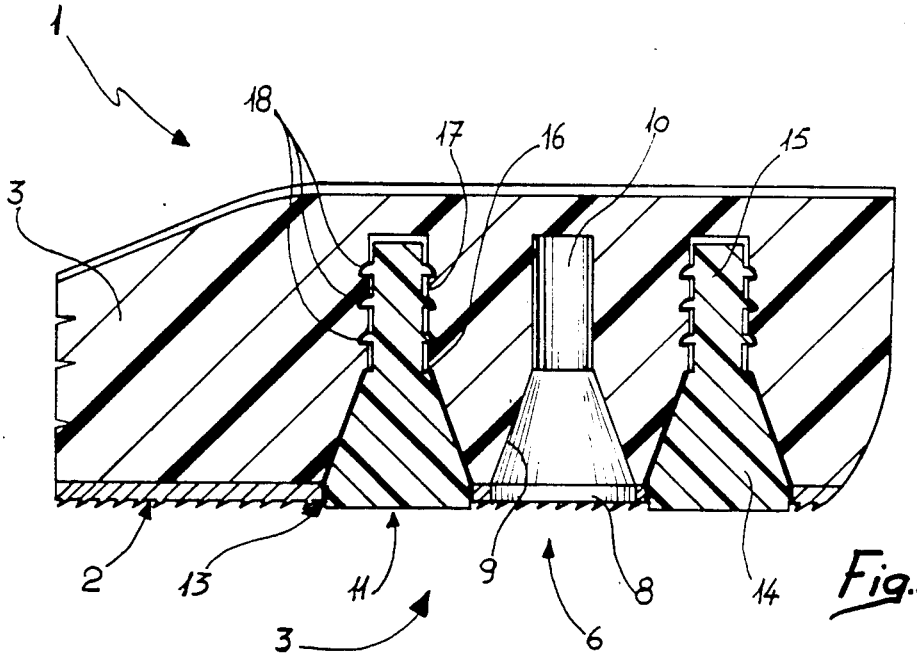
FIG. 2 is a view taken on the sectional plane 11—11 of FIG. 1.

With reference to the cited drawing figures, the sole structure 1 comprises a sole portion or sole 2 of a thermoplastic material to the top whereof a softer element or sole element 3 is bonded which if formed by foaming.

A plurality of seats 6 are formed in the bottom or treading surface 4 of the sole 2, at the heel portion or region 5.

These seats 6 are located proximately to the peripheral edge 7 of the region 5 and arranged, in the embodiment considered, to be three in number on each side, being disposed symmetrically with respect to the longitudinal centerplane of the structure 1. Their configuration is such as to include a first zone 8, of cylindrical shape and having an axial extension corresponding to the thickness of the sole 2, followed by a conical zone 9 which becomes narrower, inwardly of the zone 5 of the softer element or insole 3 to approximately one third its thickness, and then a third, cylindrical zone 10, which is extended along the same longitudinal centerline as the first to substantially span the full thickness of the element 3.

Force fitted into the seats 6 are matingly shaped elements or strengthening elements 11 comprising plugs 12 of a thermoplastic material which may have different stiffness characteristics.

Such plugs 12 have a first cylindrical zone 13 protruding slightly from the bottom portion of the element 3 and being contained within the zone 8 of the sole 2 and having a slightly larger diameter than the maximum diameter of the zone 9 of the seat 6; it is followed by a second conical zone 14, of a slightly larger size than the 9 and a third, cylindrical zone 15 which is shaped to mate with the 10 of the seat 6 defining a step 16 with the zone 14.

Provided at the lateral surface 17 of the zone 15 are annular projections 18 of the same material which are equispaced apart and adapted to improve the holding power of the element 11 in the seat 6.

Use is as follows: the user acts him/herself to insert the plugs 12 into the seats 6 according to his/her own requirements, this operation being quite rapid and easy to complete, as is the withdrawal thereof.

Thus, as an example, he/she who happens to be affected by a valgus limb, may insert along the peripheral edge, on the outer side *7a* of the structure, a series of plugs which will restrict that outward thrust, locally strengthening the sole according to a degree of stiffness sought.

That strengthening may be accomplished by changing the types of plugs, as well as by changing the number of the plugs inserted, these being manufactured with different stiffness characteristics.

Similarly, where the user is affected by a valgus limb, plugs may be placed along the peripheral edge, on the inner side *7b* of the structure.

Thus, it may be seen that the diversified compliance sole structure achieves all of the objects set forth, affording inter alia a stiffness along the peripheral region of the heel which is diversified and diversifiable, thereby accomplishing strengthening of the same both longitudinally and transversely by appropriate positioning of the plugs.

That different plug positioning feature affords improved control of the effects of lateral deformation imparted by the foot in the event that the limb be affected by either a valgus or varus condition.

Of course, any materials and dimensions, may be selected and used to meet individual requirements.

I claim:

1. A diversifiable compliance sole structure having in combination therewith a plurality of plugs, said sole structure comprising a sole, a treading surface, a sole element and a plurality of seats, said sole defining at least one bottom face and at least one top face, said treading surface being formed on said at least one bottom face of said sole, said sole element being bonded, to said at least one top face of said sole, each seat in said plurality of seats being formed in said sole structure and having at least a first substantially cylindrical zone, a second substantially conical zone, and a third substantially cylindrical zone, each plug in said plurality of plugs having a first substantially cylindrical plug zone, a second substantially conical plug zone and a third substantially cylindrical plug zone, each of said plugs being selectively, removably insertable in at least one of said seats, said first substantially cylindrical zone of said seat being adapted for removably accommodating at least a portion of said first substantially cylindrical plug zone of at least one of said plugs, said second substantially conical zone of said seat, being adapted for interconnecting said first and third substantially cylindrical zones thereof and for selectively removably accommodating said second substantially conical plug zone of at least one of said plugs, said third substantially cylindrical zone of said seat being adapted for selectively removably accommodating said third substantially cylindrical plug zone of at least one of said plugs, said second substantially conical plug zone of each of said plugs being adapted for interconnecting said first and third substantially cylindrical plug zones thereof.

2. A combination according to claim 1 wherein each of said plugs further comprises a plurality of annular projections, said annular projections being provided at said third substantially cylindrical plug zone of said plug and adapted for at least temporary engagement relationship with said third substantially cylindrical zone of said seat.

3. A combination according to claim 2 wherein said third substantially cylindrical zone of said seat defines an inner diameter, wherein said third substantially cylindrical plug zone defines an outer diameter, and wherein said annular projections each define an overall diameter, said outer diameter of said third substantially cylindrical plug zone substantially corresponding to said inner diameter of said third substantially cylindrical zone of said seat, said overall diameter defined by said annular projections being greater than said inner diameter of said third substantially cylindrical portion of said seat.

4. A combination according to claim 1 wherein said sole and said treading surface formed thereon together define a thickness dimension, and wherein said first substantially cylindrical plug zone of said plug defines and axial extension, said axial extension defined by said first substantially cylindrical portion of said plug substantially corresponding to said thickness dimension defined by said sole and said treading surface.

5. A combination according to claim 1 wherein said plurality of plugs comprises plugs having different stiffness characteristics, and which are selectively removably insertable into said seats for at least temporarily locally strengthening said sole structure against lateral deformation.

6. A combination according to claim 1 wherein said sole comprises a sole made of thermoplastic material, and wherein said sole element is manufactured by foaming a material which is softer than said thermoplastic material of which said sole is made, said third substantially cylindrical plug zone, of each of said plugs defining an overall outer diameter, said first substantially cylindrical zone of each seat in said plurality of seats being formed in said sole and defining a seat entrance diameter, said seat entrance diameter being significantly greater than said overall outer diameter defined by said third substantially cylindrical zone of said plug, for facilitating introduction of said plug into said seat.

7. A combination according to claim 6 wherein each of said plugs further comprises a plurality of annular projections, said annular projections being provided at said third substantially cylindrical plug zone of said plug, said third substantially cylindrical zone of said seat being formed in said sole element, said annular projections being adapted for at least temporary engagement relationship with said third substantially cylindrical zone of said seat.

8. A diversifiable compliance sole structure having in combination therewith a plurality of plugs, said sole structure comprising a sole, a treading surface, a sole element and a plurality of seats, said treading surface being defined by said sole, said sole element being attached to said sole remotely from said treading surface, each seat in said plurality of seats being formed in said sole structure and adapted for at least temporarily accommodating at least one of said plurality of plugs, said plurality of plugs comprising plugs having different stiffness characteristics and which are selectively removably insertable into said seats for at least temporarily locally strengthening said sole structure, each plug in said plurality of plugs including engagement means for removably retaining said plug in one of said plurality of seats, said sole element being formed of softer material than said plugs, said engagement means being adapted for plug retaining engagement relationship with said softer material of said sole element upon said plug being removably force fitted into one of said plurality of seats, wherein each seat in said plurality of seats comprises a first substantially cylindrical zone, a second substantially conical zone, and a third substantially cylindrical zone, and wherein each plug in said plurality of plugs has at least a first substantially cylindrical plug zone, a second substantially conical plug zone and a third substantially cylindrical plug zone, each of said plugs being selectively, removably insertable in at least one of said seats, said first substantially cylindrical zone of said seat being adapted for removably accommodating at least a portion of said first substantially cylindrical plug zone of at least one of said plugs, said second substantially conical zone of said seat, being adapted for interconnecting said first and third substantially cylindrical zones thereof and for selectively removable accommodating said second substantially conical plug zone of at least one of said plugs, said third substantially cylindrical zone of said seat being adapted for selectively removably accommodating said third substantially cylindrical plug zone of at least one of said plugs, said second substantially conical plug zone of each of said plugs being adapted for interconnecting said first and third substantially cylindrical plug zones thereof.

9. A combination according to claim 8 wherein said engagement means comprises a plurality of annular projections, said annular projections being provided at said third substantially cylindrical plug zone of said plug and adapted for at least temporary engagement relationship with said third substantially cylindrical zone of said seat.

10. A combination according to claim 8 wherein said engagement means comprises a plurality of annular projections, said annular projections being provided at said third substantially cylindrical plug zone of said plug and adapted for at least temporary engagement relationship with said third substantially cylindrical zone of said seat, said third substantially cylindrical zone of said seat defining an inner diameter, said third substantially cylindrical plug zone defining an outer diameter, and said annular projections each defining an overall diameter, said outer diameter of said third substantially cylindrical plug zone substantially corresponding to said inner diameter of said third substantially cylindrical zone of said seat, said overall diameter defined by said annular projections being greater than said inner diameter of said third substantially cylindrical portion of said seat.

* * * * *